United States Patent [19]

Cho

[11] Patent Number: 4,841,634

[45] Date of Patent: Jun. 27, 1989

[54] HAIR CUTTING DEVICE

[76] Inventor: Wang M. Cho, 220 S. Roselle, Apt. 224, Schaumburg, Ill. 60193

[21] Appl. No.: 283,163

[22] Filed: Dec. 12, 1988

[51] Int. Cl.[4] ..... B26B 13/00

[52] U.S. Cl. ..... 30/30; 30/124; 30/134

[58] Field of Search ..... 30/30, 124, 134, 135, 30/195, 211–213, 233.5

[56] References Cited

U.S. PATENT DOCUMENTS

| | | | |
|---|---|---|---|
| 2,665,476 | 1/1954 | Leonard | 30/30 |
| 3,855,695 | 12/1974 | Spanel | 30/30 |
| 4,744,145 | 3/1988 | Lee | 30/134 |

*Primary Examiner*—Douglas D. Watts

*Attorney, Agent, or Firm*—Birch, Stewart, Kolasch & Birch

[57] ABSTRACT

A hair cutting device for self use which comprises a comb member including a plurality of comb teeth which contain a plurality of saw-toothed members, a handle, an integral extension with an elliptical aperture, a razor member including a blade, and an engagement member for being adapted to operatively engage with the elliptical aperture, whereby when the handle is grasped, the blade slidably moves downward to cut hairs retained within the comb teeth and saw-toothed members.

4 Claims, 1 Drawing Sheet

HAIR CUTTING DEVICE

BACKGROUND OF THE INVENTION

1. Field of the Invention

The present invention relates to an improved hair cutting device and more particularly, to a unitary scissors type device for cutting hair and trimming hair by oneself with little effort being required by the user.

2. Description of the Prior Art

Many types of hair cutting devices for self use have heretofore been proposed but in general have either been unsatisfactory or have required the development of a relatively high degree of skill for satisfactory results. Such devices are more particularly described as follows: U.S. Pat. Nos. 2,536,485 to Behr; 2,661,529 to Infantino; 2,721,385 to Ames; 3,279,055 to Penn; 3,711,948 to Ford et al; 3,914,866 to Applegate; and 4,020,549 to Edwards.

SUMMARY OF THE INVENTION

Accordingly, it is an object of the present invention to provide an improved hair cutting device for self use.

Another object of the present invention is to provide a hair cutting device that is adapted to trim hair efficiently and easily without requiring skill on the part of the user and with little effort being required by the user.

A further object of the present invention is to provide a safe hair cutting device wherein the cutting element is not separated from the device when in operation thereby eliminating the possibility of injury to the user.

Yet another object of the present invention is to provide a hair cutting device that is simple in construction, economical to manufacture, easily manipulated and attractive in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a hair cutting device for self use which comprises a comb member including a plurality of comb teeth which contain a plurality of saw-toothed members, a handle, an integral extension with an elliptical aperture, a razor member including a blade, and an engagement member for being adapted to operatively engage with the elliptical aperture, whereby when the handle is grasped, the blade slidably moves downward so as to cut hairs retained within the comb teeth and saw-toothed members.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
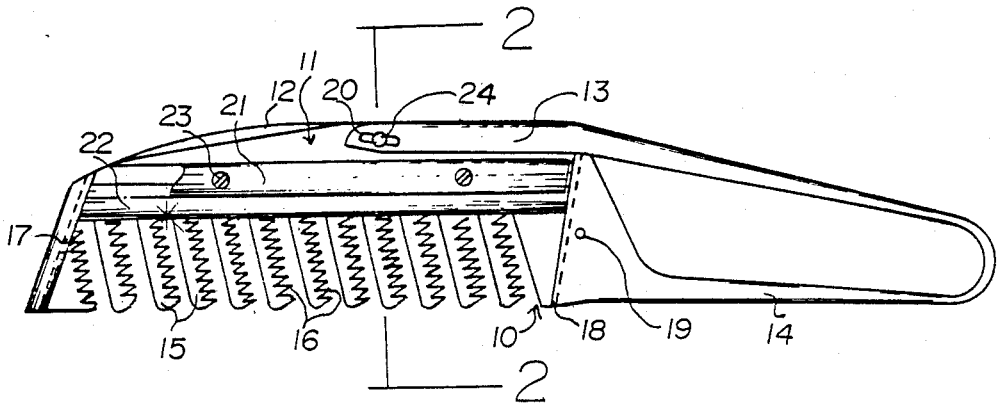
FIG. 1 is a front elevational view of a hair cutting device according to the present invention.
Figure 2:
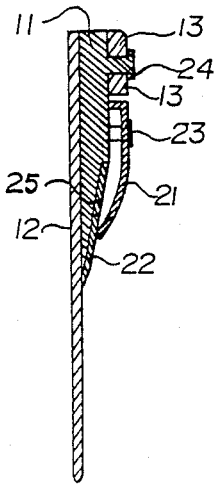
FIG. 2 is a cross-sectional view of FIG. 1, taken along line 2—2.

Referring now in detail to the drawings for the purpose of illustrating preferred embodiments of the present invention, the hair cutting device as shown in FIGS. 1 and 2 comprises a comb member 10 having a handle 14 and an integral extension 13 extending from the handle 14, a razor member 11 having a blade holder 21 with a blade 22, and an engagement member 24 for being adapted to slidably engage with an elliptical aperture 20 disposed in the end portion of the integral extension 13.

The comb member 10 includes a body member 12 which contains a plurality of comb-teeth 15 disposed in one side thereof, wherein each comb-tooth has a plurality of saw-toothed members 16 for retaining the hairs to be cut, a pair of blade channels 17 and 18 disposed at both sides thereof for operatively receiving the blade 22, and a stopper 19 for limiting downward movement of the razor member 11. As shown in FIG. 1, if the comb member 10 includes twelve comb-teeth 15, the first comb-tooth 15 has the same arrangement of saw-toothed members 16 as that of the sixth comb-tooth 15 which requires less effort by the user. The second comb-tooth 15 in turn has the same arrangement of saw-toothed members 16 as that of the seventh comb-tooth 15. Also the saw-toothed members 16 of adjacent comb-teeth 15 are arranged so as to be misaligned by 1 mm so that less hair is cut at one time.

The razor member 11 includes a shoulder for receiving the blade 22, and a blade holder 21 for holding the blade 22 located in the shoulder with a plurality of bolts 23. Therefore, the blade 22 can be replaced by removing the bolts 23. The engagement member 24 has a raised head for positioning the integral extension 13.

Figure 3:
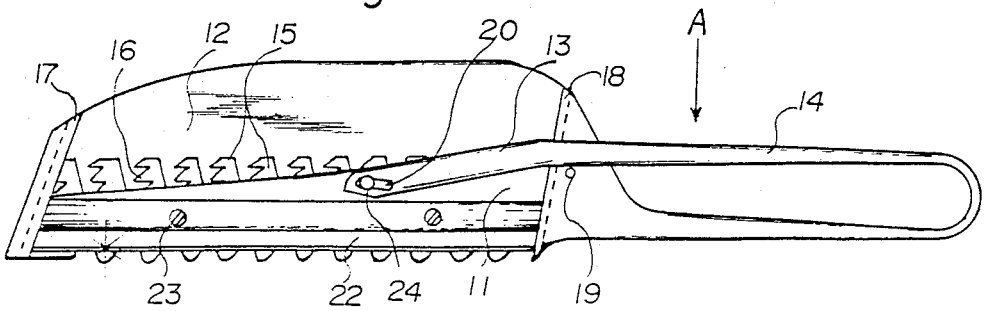
FIG. 3 is a front elevational view of the hair cutting device showing in tilted position of a razor member according to the present invention.

The comb teeth 15 may be disposed at an angle of about 10–15° about the blade 22 and the saw-toothed members 16 may be disposed at an angle of about 45° so that the hairs retained within the plurality of saw-toothed members 16 can be effectively cut when the user grasps the handle 14 and moves it in the direction indicated by arrow (A) from the open position to the olosed position as shown in FIG. 3. At this time, the engagement member 24 slidably engages with the elliptical aperture 20 and moves from one side to the other side for downwardly moving the blade 22 along the pair of blade channels 17 and 18. Thus, by tilting the razor member 11 to slightly move downward, the comb member 10 is utilized in the normal manner to comb the hair, prior to or after the cutting of the same. Also when the razor member 11 is moved down, since the stopper 19 limits the downward movement of the razor member 11, it cannot move over the comb-teeth 15 so that the cutting device is very safe. Of course, when the user releases the grasped handle 14 the razor member 11 returns back to its original position causing the biasing power of the handle 14. The hair cutting device of the present invention may be used for cutting hair of all kinds, including that of humans and animals.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A hair cutting device comprising:

a comb member including:

a comb body, a plurality of comb teeth disposed in one side of said comb body, said comb teeth containing a plurality of saw-toothed members, a pair of blade channels disposed at both sides of said comb body, and a bias handle extending from said comb body, to an integral extension having an elliptical aperture; and a razor member including:

a razor body having a blade holder a blade for engaging with said blade holder, and an engagement member having a raised portion for being adapted to operatively engage with said elliptical aperture of the integral extension, whereby upon grasping the handle, the razor member moves downward to cut hairs retained within the plurality of the comb teeth and saw-toothed members.

2. The hair cutting device of claim 1, wherein the comb body is provided with a stopper for limiting the downward movement of the razor member.

3. The hair cutting device of claim 1, wherein the angle between the comb teeth and the blade is about 10–15°.

4. The hair cutting device of claim 1, wherein the blade holder is provided with a plurality of bolts for fixing the blade disposed therewithin.

* * * * *